US005388673A

United States Patent [19]

Rohner, III

[11] Patent Number: 5,388,673

[45] Date of Patent: Feb. 14, 1995

[54] HAND HELD BRAKE FOR USE WITH FOOT-MOUNTED WHEELED VEHICLES

[76] Inventor: Joseph A. Rohner, III, 3072 Triumph La., Boise, Id. 83705

[21] Appl. No.: 79,729

[22] Filed: Jun. 21, 1993

[51] Int. Cl.[6] ..... B60T 1/14

[52] U.S. Cl. ..... 188/84; 188/5; 280/11.2

[58] Field of Search ..... 280/11.2, 11.26, 826; 15/116.1, 116.2; 115/176.1, 176.2, 176.3, 176.5; 188/5, 84; 135/84, 85, 86; 273/67 A

[56] References Cited

U.S. PATENT DOCUMENTS

| | | | |
|---|---|---|---|
| 1,369,580 | 2/1921 | Uchytil | 135/86 |
| 1,985,726 | 1/1933 | Heldman | 280/826 |
| 3,763,966 | 10/1973 | Close | 188/5 |
| 3,940,134 | 2/1976 | Bieganowski | 273/67 A |
| 4,386,794 | 6/1983 | Roberts | 280/826 |
| 5,236,222 | 8/1993 | Fletcher | 188/5 |

FOREIGN PATENT DOCUMENTS

| | | | |
|---|---|---|---|
| 0724871 | 2/1955 | United Kingdom | 15/116.2 |

*Primary Examiner*—Robert J. Oberleitner
*Assistant Examiner*—Chris Schwartz

[57] ABSTRACT

A hand-held braking device for use with foot-mounted wheeled vehicles such as in-line skates, rollerskates, skateboards, roller skis, and other similar wheeled vehicles designed to control speed or to stop quickly in a short distance. The device consists of a pole whose length is approximately 90% of the height of the user. The top end has a handle; the center has a foam rubber hand grip; the bottom end has a brake pad assembly. The brake pad assembly comprises a front and a back trapezoid plate fastened to the bottom end of the pole, between which is fastened a replacable trapezoid pad of rubber or similar material, The rubber pad is approximately twice as large as the two plates and extends below the lower edges of the two plates. The rubber pad and the two plates are both curved to form a scoop, The bottom 6 to 8 inches of the pole is bent in a curve at approximately a 20′ angle to the upper end of the pole. Speed control or stopping is caused by friction between the ground surface and the rubber pad, The rubber pad engages the ground either by being dragged from the rear or by being extended to the front on either the right or left side of the body. A third technique for engaging the ground surface is thrusting the brake pad assembly rearward between the legs and engaging the ground surface by "sitting" on the pole while holding the handle and the hand grip. The degree of braking is determined by the amount of pressure exerted downward on the rubber pad with the pole while being held with both hands.

7 Claims, 5 Drawing Sheets

HAND HELD BRAKE FOR USE WITH FOOT-MOUNTED WHEELED VEHICLES

BACKGROUND OF THE INVENTION

1. Field of the Invention

The present invention pertains primarily to a braking system for use with in-line skates, but which can also be used effectively with roller skates, skate boards, possibly roller skis, and other similar foot-mounted wheeled vehicles in which both hands can be freed up for applying the brake.

2. Description of the Prior Art

It is estimated by an in-line skate club that there are in excess of 10 million users of in-line skates. The number grows dramatically every year as does the number of scrapes, bruises, and broken bones caused by falls resulting from ineffective braking systems and techniques. Until the present time, all attempts at stopping have been focused on effecting speed reduction and stopping with devices attached to the wheeled vehicles in various fashions. The skateboard with its tail drag, the roller skate with its toe brake, the roller ski with its truncated cone, and the in-line skate with its variations of the toe and heel brake all attempt to address speed and braking with physical attachments to the vehicle.

While all of these attached devices utilize ground surface contact to induce friction for slowing the stopping, there are at least two general problems with this approach. The first is the fact that the lower body of the user tends to slow more quickly than the upper body because the friction in the area of the feet doesn't simultaneously slow the upper body. The result is a tendency to pitch forward. The greater the speed, the greater the risk of pitching forward. Secondly, most of the inventions and techniques in use today are somewhat awkward and require considerable practice to develop the necessary skill to use them effectively. A third problem more particular to the in-line skate stems from the extremely high speeds of up to 30 m.p.h. that can be reached. The result is the need for a much longer stopping distance and much greater instability when attempting to apply the vehicle-attached systems.

Johnson's skateboard, U.S. Pat. No. 4,168,076, with its tail drag requires considerable balancing ability because the front wheels might be raised off the ground in order to engage the ground surface with the tail drag. The vehicle is much less stable with only two wheels on the ground and the dragging tail could cause an upset by hitting uneven surfaces, rocks, etc. The risk of pitching forward is acute at the point of engagement. The roller ski does not achieve the high speed of the in-line skates and experienced cross-country skiers are generally skilled in the "snow-plow" maneuver. However, there is still a tendency to pitch forward with Jennings' roller ski braking system U.S. Pat. No. 4,892,332 due to the friction generated as the truncated cone engages the ground. The toe brake such as Lander's toe-mounted rotatable cylinder U.S. Pat. No. 5,207,438 and similar toe-mounted friction devices on the roller skate and the in-line skate both require the user to balance on one leg while extending the other leg rearward. This technique requires considerable practice and balance, and results in much less stability since the entire weight of the body must be centered properly on one foot in order to prevent falling. Even the T-stop technique used with the in-line skate requires a one-legged glide with the other leg extended rearward and dragging on the ground surface. Both of the aforementioned braking methods also entail the risk of pitch forward.

The heel brake used almost exclusively with the in-line skate is one of the most awkward and dangerous of all. With the heel brake by Roberts, U.S. Pat. No. 5,197,572, and others, the user must shift the weight to one foot, thrust one foot forward, and glide on the opposite foot all while engaging the ground with the rubber pad of the braking foot. Thrusting the foot forward is unnatural and awkward balance is very tricky and the risk of falling forward is greater the higher the speed is. At high speeds and on steep grades, the heel brake stops neither quickly nor safely if at all.

In addition to the above shortfalls, none of the Prior Art embodies a form that can be used with all foot-mounted wheeled vehicles in which the hands are free.

SUMMARY OF THE INVENTION

The general purpose of the present invention is to provide an easily portable, easily mastered, extremely functional device that can be used for both speed control and for stopping quickly by users of a variety of different foot-mounted wheeled vehicles in which the hands are free to utilize the device.

According to one embodiment of the present invention, there is provided a brake pad assembly having a front and back side, mounted on the bottom of a hand-held pole, including a replaceable rubber trapezoid brake pad fastened between an upper and lower trapezoid plates. The rubber pad has a front surface and a bottom edge which engages the ground surface during implementation of one of the three techniques by the user. The pole has a handle on the top end and a foam rubber covered hand grip in the center part.

The three primary stopping techniques are:

1. The forward scrape

The pole is held by the upper and the lower end of the foam rubber hand grip and is held tightly along either SIDE of the body. The brake pad assembly is extended forward with the front of the brake pad assembly facing forward. The ground surface is engaged by pressuring the rubber pad downward with both hands, causing the rubber pad to fold under and rearward, The resulting friction slows and/or stops the vehicle.

2. The side drag

The pole is held by the handle and by the foam rubber hand grip along either side of the body. The brake pad assembly is extended rearward with the front side facing rearward. The rubber pad engages the ground surface by downward pressure exerted at the hand grip area. The scooping action caused by the rubber pad engaging the ground surface generates the friction which slows and/or stops the vehicle.

3. The straddle drag

The pole is held by the handle and by the hand grip, The brake pad assembly is extended rearward between the legs at the same attitude as the previous technique. The user causes the rubber brake pad to engage the ground by "sitting" back on the pole. The friction generated slows and/or stops the vehicle.

The primary objects and advantages of the present invention are:

1. It can easily be hand carried by in-line skaters, roller skaters, skate boarders, and even by roller skiers using a sling such as is used by combat ski troops to carry rifles.

2. Any user can master one or more of the three primary stopping techniques In ten to fifteen minutes of practice at the most.

3. Any one of the three stopping techniques (the forward scrape, the side drag, or the straddle drag) can slow the speed of the user to any desired speed or bring the user to a dead stop in a very short distance on paved surfaces of any grade.

4. Pitch forward is eliminated since the extended friction pad contacts the ground surface at least two to femur feet distant from the user allowing for uniform slowing of both upper and lower body.

5. Greater stability and balance are achieved because there are always three points of contact with the ground—the two legs and the rubber brake pad mounted at the bottom end of the pole. Additionally, no friction is generated by either foot.

Related objects and advantages of the present invention will be apparent from the following description.

DESCRIPTION OF THE PREFERRED EMBODIMENT

Figure 1:
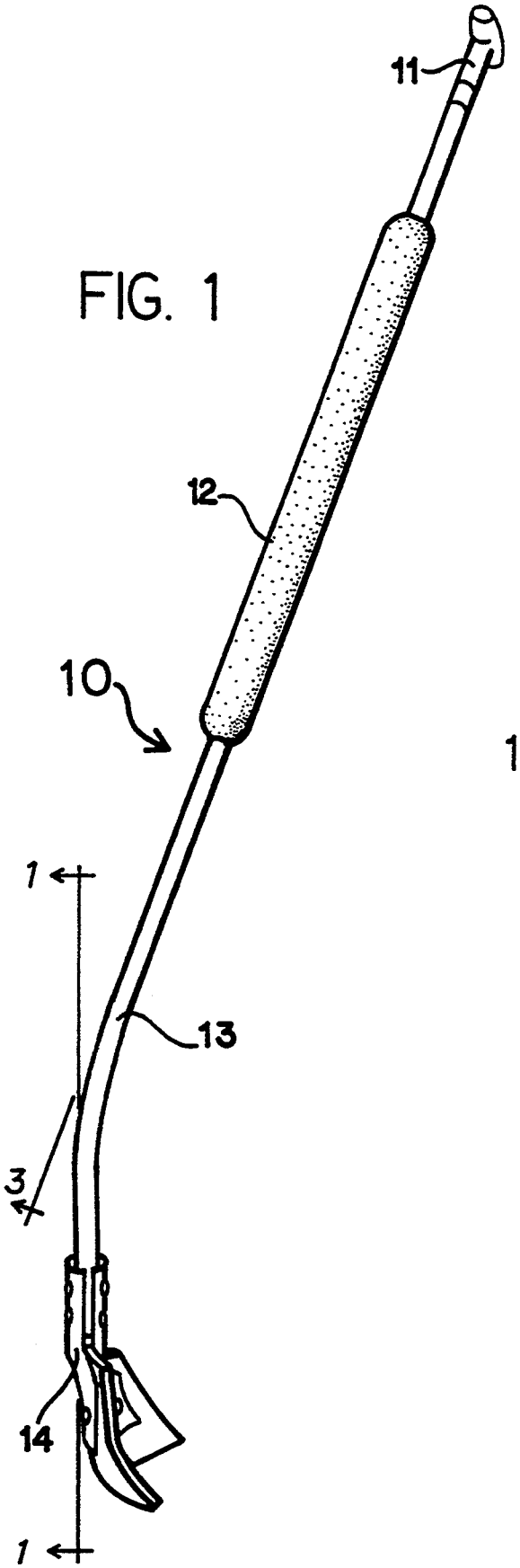
FIG. 1 is a perspective of the complete braking device according to a typical embodiment of the present invention.

For the purposes of promoting and understanding the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 6:
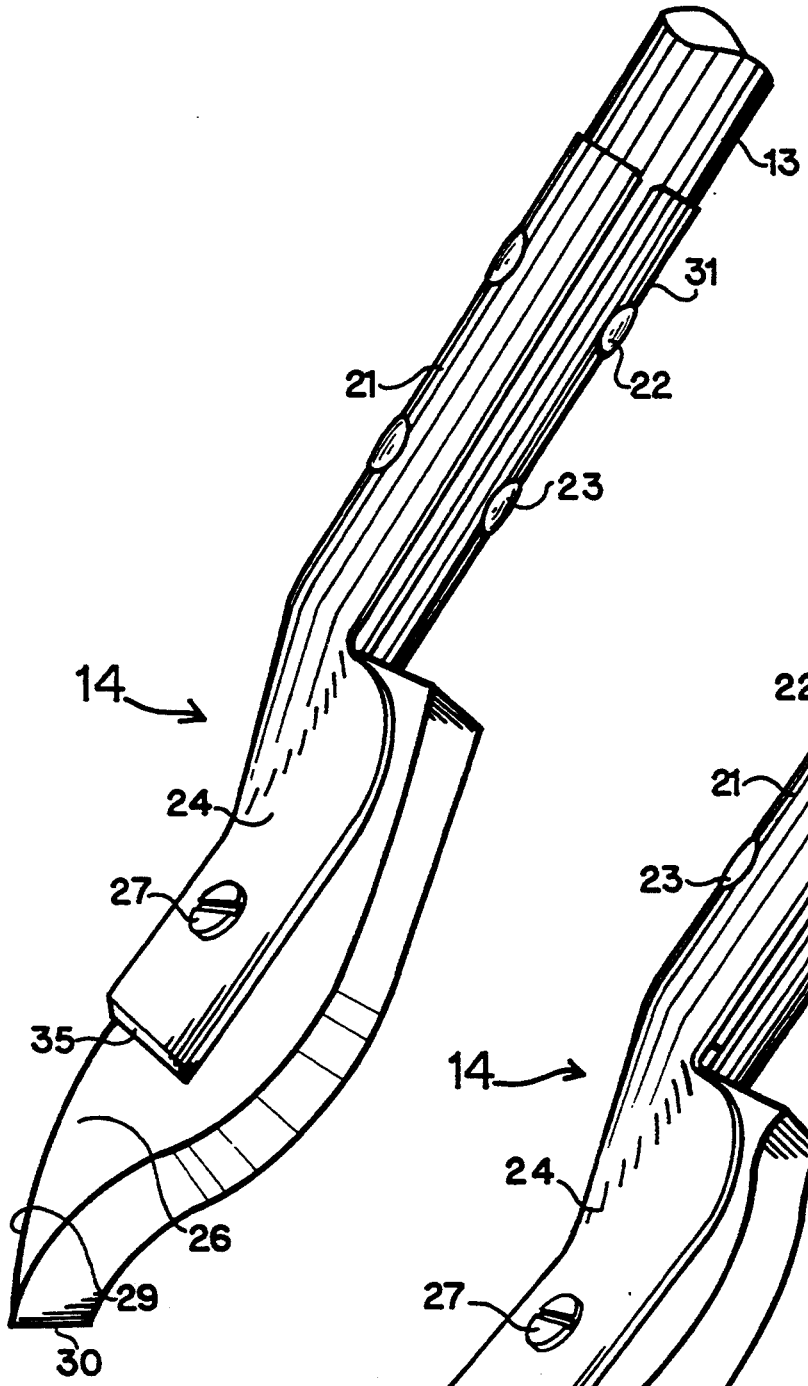
FIG. 6 is a sideview of the brake pad assembly showing the position of the brake pad when engaged against the ground surface during the "side drag" and the "straddle drag" maneuvers.
Figure 7:
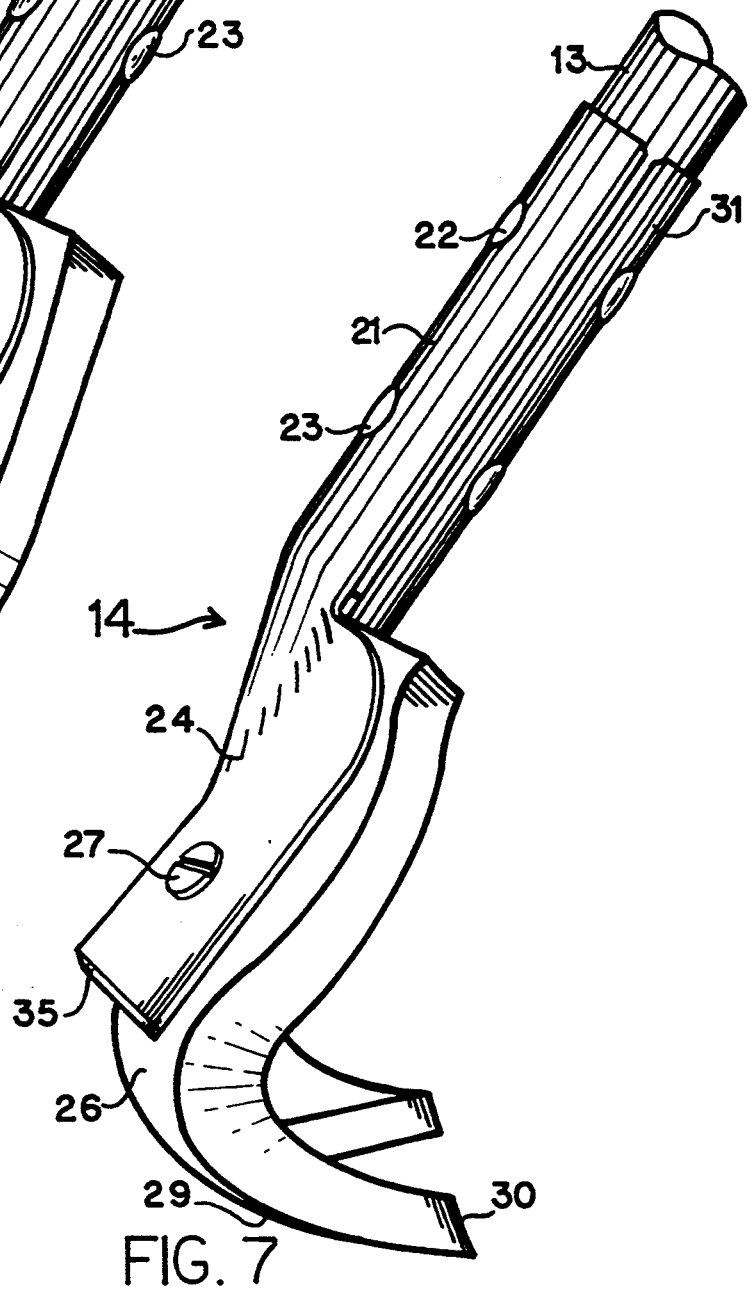
FIG. 7 is a side view of the brake pad assembly showing the position of the brake pad when engaged against the ground surface during the "forward scrape" maneuver.

Referring to FIG. 1, there is illustrated a braking device 10 which is comprised of a pole 13 to which are attached a handle 11, a foam rubber hand grip 12, and a brake pad assembly 14. The lower end of pole 13 is bent along plane line 1 at a 20 degree angle to plane line 3 on the upper end of pole 13. Referring to FIG. 6 and FIG. 7, the bend at the lower end of pole 13 along plane line 1 is at an angle of 20 degrees so that edge 30 of FIG. 6 will engage the ground surface at the proper angle as depicted in FIG, 6 during the 'side drag' and the 'straddle drag' maneuvers, and so that front surface 29 of FIG, 7 will roll backward and engage the ground surface at the proper angle as depicted in FIG. 7.

Figure 2:
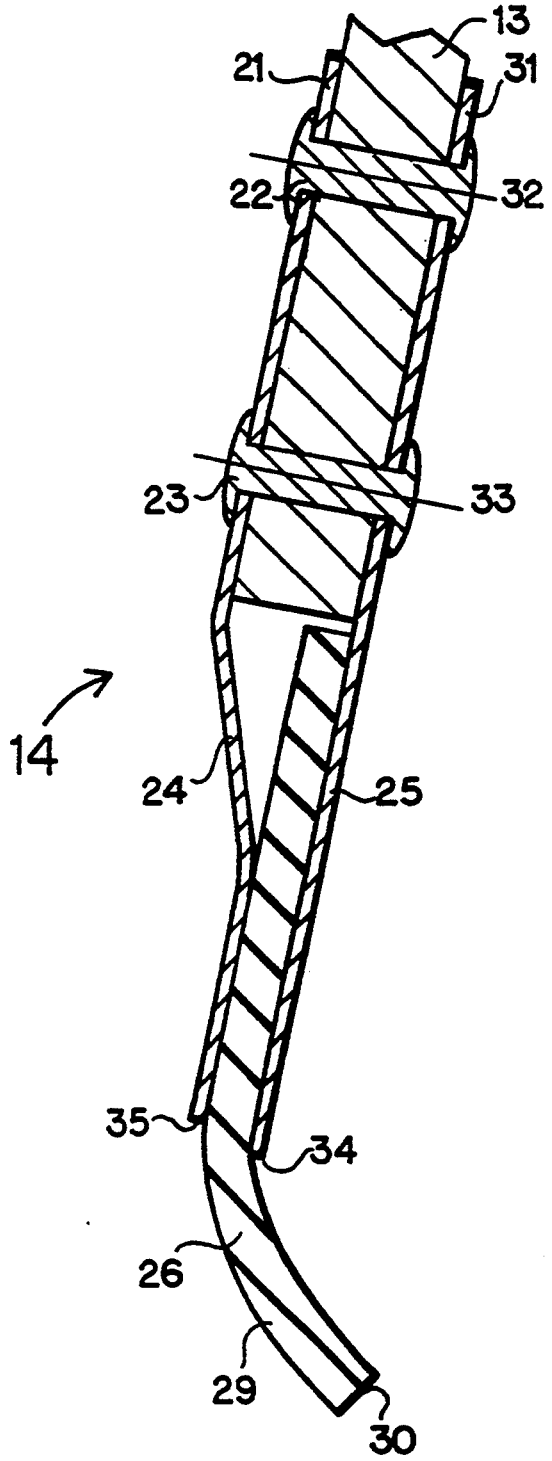
FIG. 2 is a sectional view of the brake pad assembly taken along line 2—2 in FIG. 4.
Figure 3:
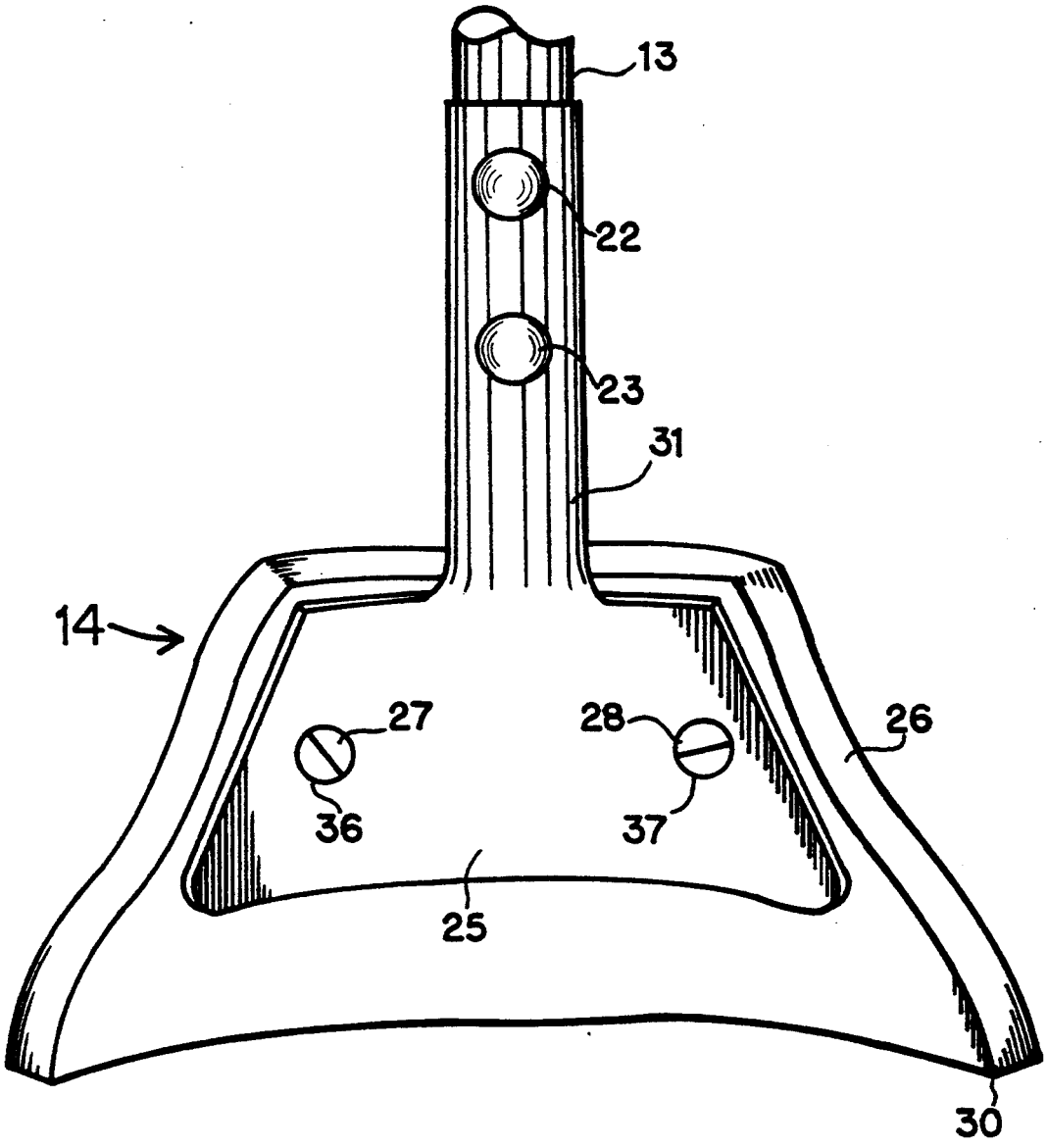
FIG. 3 is the rear view of the brake pad assembly which comprises a portion of the FIG. 1 braking device.
Figure 4:
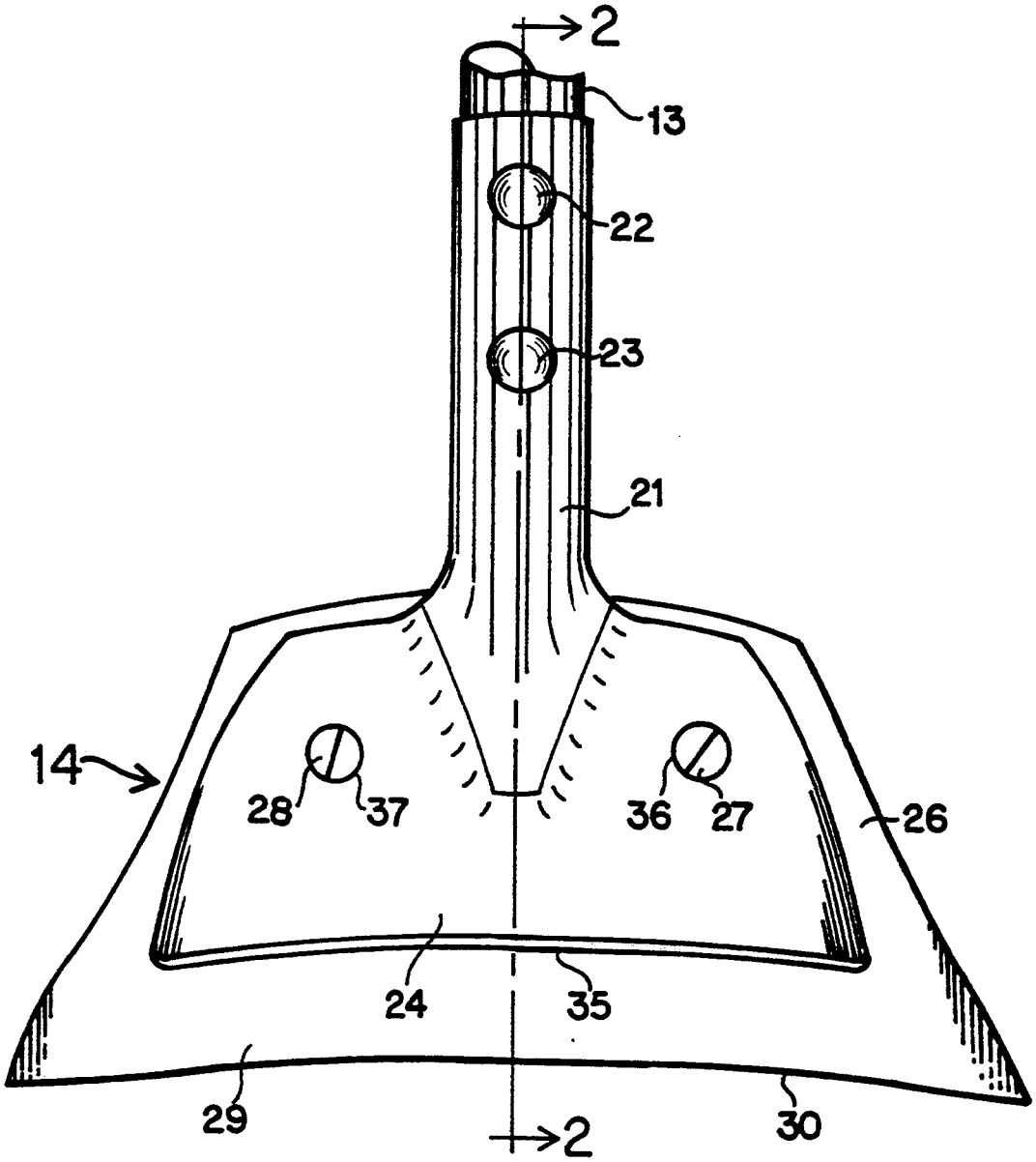
FIG. 4 is the front view of the brake pad assembly which comprises a portion of the FIG. 1 braking device.

Referring to FIG. 2, there is illustrated a sectional view of brake pad 14 showing a front plate 24 with a fastening sleeve member 21; a back plate 25 with a fastening sleeve member 31, an upper and a lower sleeve retaining nuts and bolts 22 and 23 respectively. Nuts and bolts 22 and 23 pass through holes indicated by lines 32 and 33 respectively. Nuts and bolts 22 and 23 fasten brake pad assembly 14 to pole 13. Referring to FIG. 3 and 4, there is illustrated brake pad 26 fastened between plates 24 and 25 by brake pad retaining nuts and bolts 27 and 28 through holes 36 and 37.

FIGS. 3 and 4 also depict the curvature of plates 24 and 25 as well as brake pad 26. The curvature sweeps rearward from either side of line 2—2. Referring to FIG. 2, the curvature of pad 26 is further illustrated in a sectional perspective.

Also in FIG. 2, the bottom edge 34 of back plate 25 is shown to be a quarter inch lower than the corresponding edge 35 of front plate 24. This prevents edge 35 from engaging the ground surface during the forward scrape maneuver illustrated in FIG. 7.

Figure 5:
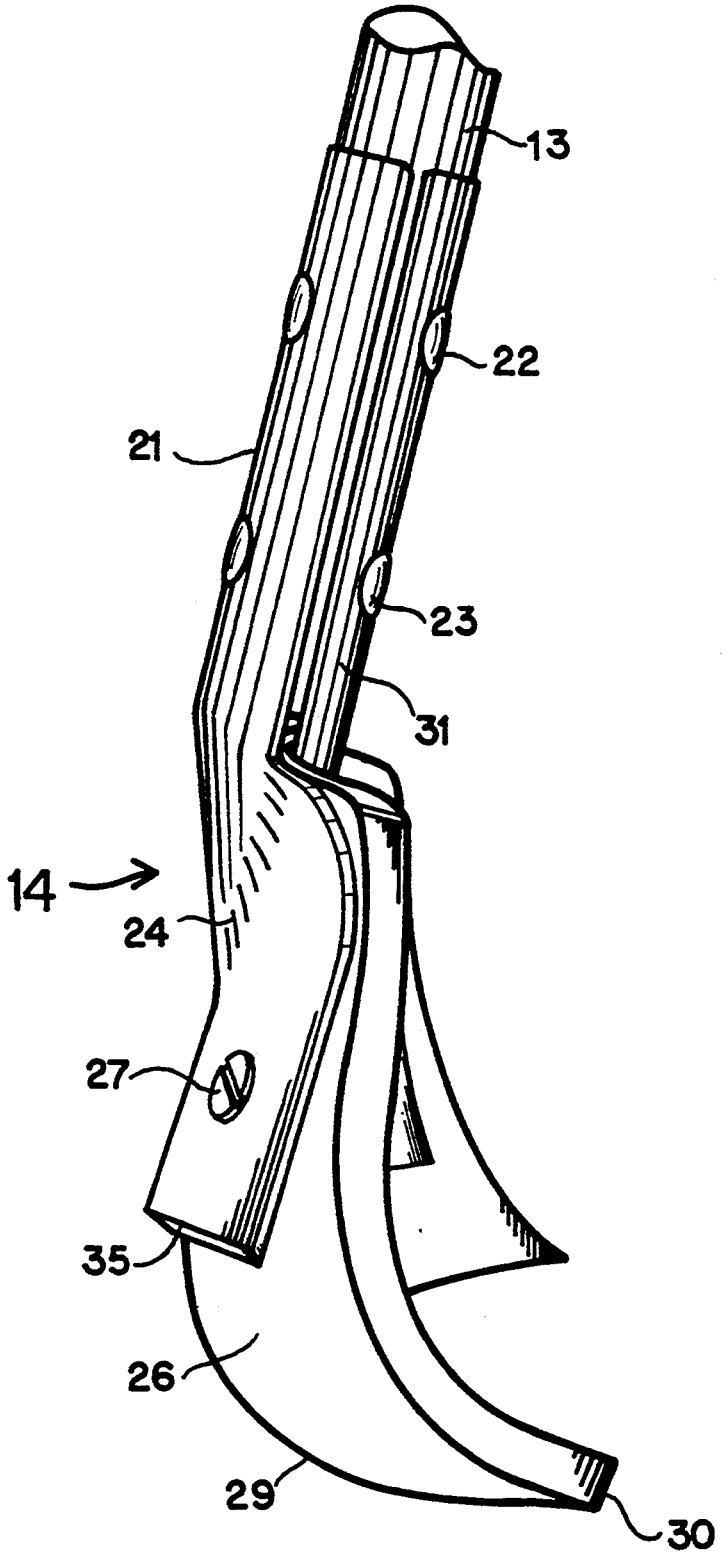
FIG. 5 is a side view of the brake pad assembly showing the rubber brake pad in the disengaged position.

Referring to FIG. 5, brake pad 26 is depicted in the relaxed position. Referring to FIG, 6 brake pad 26 is depicted with edge 30 engaging the ground surface during the "side drag" and the "straddle drag" maneuver. Referring to FIG. 7, brake pad 26 is depicted with front surface 29 engaging the ground surface during the forward scrape maneuver.

OPERATION

The braking device is operated in one of three techniques described as the side drag, the straddle drag, and the forward scrape. During each maneuver, stopping and speed control result from engaging the ground surface with brake pad 26.

The forward scrape maneuver is described as follows for a right-handed user. The upper end of hand grip 12 is held in the right hand. The lower end of hand grip 12 is held in the left hand. The right forearm rests along the surface of pole 13 above hand grip 12, Brake pad assembly 14 is extended forward with front plate 24 and front surface 29 of brake pad 26 facing the direction of travel. Front surface 29 of brake pad 26 is pushed into the ground surface causing front surface 29 to engage the ground surface. As front surface 29 engages the ground surface, brake pad 26 bends as illustrated in FIG. 7. The friction generated can be increased or decreased by adjusting the downward pressure with both hands at hand grip 12. The friction will either control or reduce speed or will bring the user to a rapid stop as desired on virtually all grades at all rates of speed.

The side drag maneuver is described as follows for a right-handed user. Handle 11 is gripped with the left hand. Hand grip 12 is gripped with the right. The brake pad assembly is extended rearward along the right side of the body. The front plate 24 and front surface 29 of brake pad 26 face the rear away from the direction of travel. To engage the ground surface, the left arm is pushed forward and to the right while holding handle 11. The right arm is held rigid and downward along the right side of the body and bottom edge 30 of brake pad 26 is made to engage the ground surface by pressuring straight downward at handgrip 12 with the right hand. As bottom edge 30 is engaged against the ground surface, brake pad 26 is bent as illustrated in FIG. 6. The friction generated can be increased or decreased by adjusting the downward pressure with the right hand at handgrip 12. The friction generated by this maneuver is best used to reduce speed on downhill grades and to affect a complete stop in a short distance on gentle to level grades. However, on extremely steep grades, it is difficult to generate enough pressure with this maneuver to affect a quick stop in a short distance.

The straddle drag maneuver is described as follows, also for a right-handed user. Handle 11 and hand grip 12 are gripped as in the side drag maneuver. The brake pad assembly 14 is extended rearward between the legs. Front plate 24 and front surface 29 face rearward away from the direction of travel also as in the side drag maneuver. To engage the ground surface, the left arm is pushed straight forward while holding handle 11. The right arm is held rigid and downward along the center of the body. Bottom edge 30 of brake pad 26 is made to engage the ground surface by pressuring straight downward at handgrip 12 with the right hand, or by sitting downward on pole 13 below handgrip 12. The friction can be increased or decreased by adjusting the downward pressure with the right hand at handgrip 12 or by sitting harder or lighter on pole 13 below handgrip 12. This maneuver is extremely effective at controlling and slowing speed as well as stopping completely on the steepest paved grades.

While the invention has been illustrated and described in detail in the drawings and the foregoing description, the same is to be considered illustrative and not restrictive in character, it being understood that only the preferred embodiment has been shown and described and that all changes and modifications that come within the spirit of the invention are desired to be protected.

What is claimed is:

1. A hand held brake for use with foot-mounted wheeled vehicles comprising:

a tubular body having a top end, a middle section, and a bottom, and said top end having a handle for gripping said top end, said middle section having a tubular hand grip encircling said middle section as a means for gripping said middle section of said tubular body;

a bend in said tubular body approximately 6 to 8 inches above the bottom end of said tubular body, said bend of which is at an angle of 20 degrees, a brake means attached to the bottom end of said tubular body for slowing or stopping the particular wheeled vehicle in use through engaging the ground surface by pressing said brake means at the bottom end of said tubular body downward;

said brake means including one front and one back curved plates with means for attaching said plates to the bottom end of said tubular body, said means including sleeves on the upper part of each plate, said sleeves each having two holes aligned with like holes in the bottom end of said tubular body to receive two nuts and bolts with which to secure said plates, a depending stop member of rubber material fastened between the two plates for engaging the ground surface when said stop member is pressed downward, where said rubber material is of the proper thickness so that said stop member will roll backward or forward when the ground surface is engaged, means for securing said stop member between said plates, said securing means being at least two nuts and bolts which are connected through two receiving holes passing through both said plates and said stop member.

2. The brake of claim 1 wherein said stop member is in the general shape of a trapezoid.

3. The brake of claim 2 wherein said trapezoidally shaped member is curved to the rear on both sides and on the bottom.

4. The brake of claim 1 wherein said stop member is formed from friction generating material.

5. The brake of claim 1 wherein said tubular grip is of foam rubber material.

6. The brake of claim 1 wherein said tubular body is aluminum.

7. The brake of claim 1 wherein the bottom edge of said back plate is approximately a quarter inch lower than said front plate.

* * * * *